US007227550B2

(12) United States Patent
Pasqualini et al.

(10) Patent No.: US 7,227,550 B2
(45) Date of Patent: Jun. 5, 2007

(54) PROCESSING MODULE FOR A COMPUTER SYSTEM DEVICE

(75) Inventors: Giuseppe Pasqualini, Monza (IT); Luigi Albani, Merate (IT); Giovanni Lonoce, Lissone (IT)

(73) Assignee: Koninklijke Philips Electronics, N.V., Eindhoven (NL)

( * ) Notice: Subject to any disclaimer, the term of this patent is extended or adjusted under 35 U.S.C. 154(b) by 376 days.

(21) Appl. No.: 10/215,066

(22) Filed: Aug. 8, 2002

(65) Prior Publication Data

US 2003/0038823 A1 Feb. 27, 2003

(30) Foreign Application Priority Data

Aug. 27, 2001 (EP) ..... 01203228

(51) Int. Cl.
*G09G 5/00* (2006.01)

(52) U.S. Cl. ..... 345/582; 345/583; 345/587; 345/588; 345/204; 345/690

(58) Field of Classification Search ..... 345/660, 345/661, 589, 594, 597, 582, 587, 588, 583, 345/204, 690
See application file for complete search history.

(56) References Cited

U.S. PATENT DOCUMENTS 4,969,046 A * 11/1990 Sugimoto et al. ..... 348/839
5,874,937 A 2/1999 Kesatoshi ..... 345/127
5,953,074 A 9/1999 Reddy ..... 348/558
6,611,249 B1 * 8/2003 Evanicky et al. ..... 345/102
2001/0030657 A1 * 10/2001 Hamon ..... 345/660
2002/0021294 A1 * 2/2002 Jun, II ..... 345/204
2002/0030695 A1 * 3/2002 Narui et al. ..... 345/698
2002/0032875 A1 * 3/2002 Kashani ..... 713/300
2002/0080091 A1 * 6/2002 Acharya et al. ..... 345/2.1

FOREIGN PATENT DOCUMENTS

EP 0665491 A2 8/1995
EP 0969443 A1 1/2000
EP 1148465 A1 10/2001
WO 0129811 A1 4/2001

* cited by examiner

*Primary Examiner*—Kee M. Tung
*Assistant Examiner*—Mike Rahmjoo
(74) *Attorney, Agent, or Firm*—Yan Glickberg

(57) ABSTRACT

A processing module converts an input signal, which is generated in a computer system device, into a digital output signal at a video output. The digital output signal is adapted to be visualized by a display device. The processing module includes a scaler for scaling a resolution of the output signal to match a resolution of the display device. The processing module can be combined with a display adapter which incorporates a graphical processor and memory. Furthermore, the processing module may include a selector for selecting a resolution for the output signal, corresponding to a resolution of the display device.

14 Claims, 1 Drawing Sheet

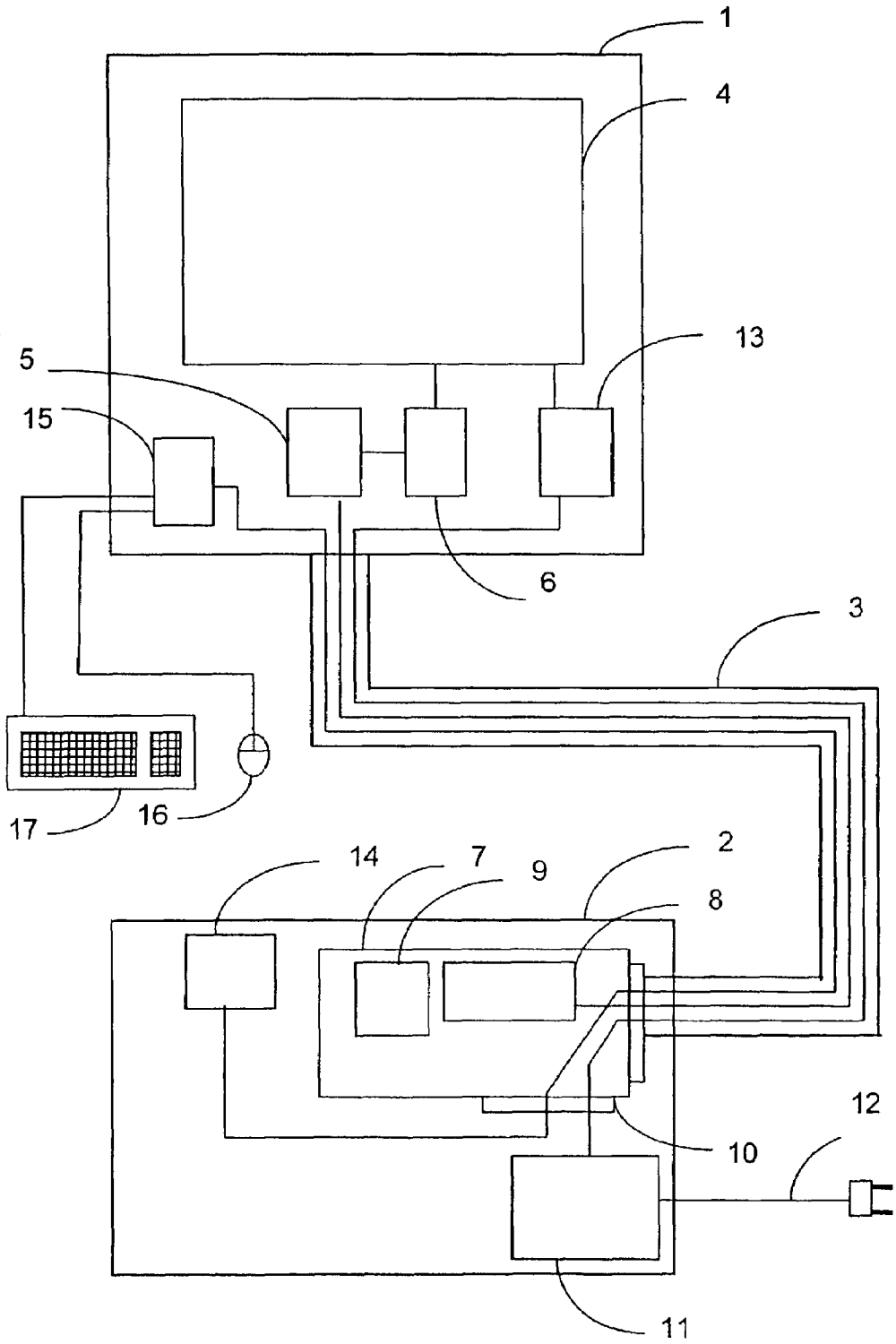
1
4
13
5
15
6
3
17
16
14
7
9
2
8
12
10
11

PROCESSING MODULE FOR A COMPUTER SYSTEM DEVICE

The invention relates to a processing module for converting an input signal, which is generated in a computer system device, into a digital output signal at a video output of the computer system device, the digital output signal being adapted to be visualised by a display device. The invention also relates to a computer system device comprising such a processing module. Finally, the invention relates to a method of displaying a video signal generated in a computer system device on a display device.

Recently, a digital display device, such as a Liquid Crystal Display (LCD) has been commonly used instead of a Cathode Ray Tube (CRT) display, as a display in a monitor in a personal computer system, i.e. to display information in response to a video signal from a computer system device, such as a personal computer. Commonly, a monitor comprising such a digital display device further comprises processing and driving electronics, a high voltage supply and a low voltage supply.

EP 0 953 895 discloses a display adapter for use in a computer system, the display adapter having an analog output for coupling the adapter to a CRT monitor and a digital output for coupling the adapter to an LCD panel. The display adapter is equipped with a video controller providing a digital and analog video signal complying with a VGA standard. The digital video signal is converted by a transmitter into four serial streams, comprising red, green, blue and timing information, respectively. The serial streams incorporate a Transition Minimised Differential Signalling (TDMS) coding scheme for reduced electromagnetic interference, and can be transmitted to an LCD panel via a cable which is coupled to the digital output.

In the context of this document, a signal may comprise a single signal but also a plurality of signals, such as parallel bits supplied on a composite line.

The prior art has a problem in that the signal generated by the computer system has a format complying with a standardised format, such as VGA, XGA, SXGA, UXGA, etc., where the display, however, has a resolution which depends on the number of pixels. To convert the resolution of the signal from the computer system into the resolution which is required by the display, the display includes a "scaler" device which converts the resolution of the signal from the computer system into the resolution required by the display. The scaler device normally consists of complex electronics, such as a Digital Signal Processor (DSP) which increases the manufacturing cost, volume, and power consumption of the display.

It is an object of the invention to simplify a monitor which accommodates a display device.

To achieve this and other objects, the processing module according to the invention is characterized in that it comprises scaling means for scaling a resolution of the output signal to match a resolution of the display device. If the processing module (which may be installed in the computer system device) scales the resolution of the output signal to match the resolution of the display device, no further scaling in the monitor, which accommodates the display device, is required. This means that power consumption, dimensions and manufacturing cost of the monitor can be reduced.

Advantageously, the processing module is integrated with a display adapter which incorporates graphical processing and memory means. In this way, the scaling can be easily implemented, as processing modules according to the state of the art include graphical processing means, such as a DSP which can easily perform the scaling, thus resulting in a cost-efficient solution. Alternatively, an input of the processing module may be coupled to a (digital or analog) output of a display adapter according to the state of the art, the processing module receiving a video signal from the display adapter. As a result, the processing module may be used in combination with an existing display adapter.

Advantageously, the processing module comprises selection means for selecting a resolution for the output signal, corresponding to a resolution of the display device. This allows the processing module to communicate with display devices having various resolutions, as the selection means allow the processing module to select a resolution corresponding to the resolution of the display device connected or to be connected to the computer system device.

Advantageously, the output signal complies with a Low Voltage Differential Signalling (LVDS), Transitions Minimised Differential Signalling (TMDS) or Reduced Swing Differential Signalling (RSDS) protocol. These protocols allow the output signal to be transmitted in a serialised form while minimizing EMIRFI noise, as well as to use a cable incorporating a small number of conductors. It is also possible to apply any other suitable encoding scheme or protocol, making use of a suitable connection means.

Advantageously, the processing module further comprises image adaptation means for adapting a general parameter, such as brightness, contrast or colour balance of an image to be visualised. This eliminates the need for separate controls on the monitor, thus reducing manufacturing cost and enhancing the exterior design of the monitor. The parameters can easily be altered by a user (for example, via a keyboard or other peripheral device) by means of suitable software. A person skilled in the art will appreciate that a video signal and/or a control signal, which is directed from the processing module to the monitor, can be applied to transfer information concerning the adapted general parameter to the monitor.

Advantageously, the processing module is adapted to be mounted in the computer system device. In this case it is further advantageous if it is adapted to be coupled to a bus structure comprised in the computer system device. This allows the processing module to be installed in an enclosure of the computer system device and to make use of standard, existing extension means for coupling a display adapter according to the state of the art to the computer system device.

The processing module may further include power supply means adapted to provide a low voltage DC supply voltage to a monitor accommodating the display device, the monitor being coupled to the processing module. Therefore, only one cable between the computer system device and the monitor is required, as both the signal and the supply voltage can be applied to the monitor by means of a single cable. The monitor can also be brought into a standby state by simply reducing or removing the DC supply voltage which is supplied by the processing module to the monitor. This can be easily implemented with a switching means, such as a software-controlled switch, thus eliminating the need for complex standby circuitry in the monitor which provides a further reduction of the manufacturing cost of the monitor.

The invention further relates to a computer system device comprising a processing module according to the invention for transmitting information to be visualised to a monitor.

The invention also relates to a method of displaying a video signal generated in a computer system device on a display device, the method comprising the steps of scaling, in the computer system device, a resolution of the video signal so as to match a resolution of the display device, and transmitting the scaled video signal to the display device.

Advantageously, the method comprises the further step of inputting the resolution of the display device into the computer system device, prior to scaling a resolution of the video signal so as to match a resolution of the display device. In this way, the computer system device can select a correct resolution which matches the resolution of the display device, because the resolution of the display device is transmitted to the computer system device. As a result, various monitors each having a display device with a different resolution can be used.

The invention thus simplifies the system comprising a computer system device coupled to a monitor, as, instead of converting the information to be visualised into a certain format having a standardised resolution, such as a VGA resolution, which is transferred to the monitor and then again converted into a format which matches the resolution of the display device, the information to be visualised can be converted in the computer system device into a signal having a resolution which corresponds to the resolution of the display device, so that a subsequent conversion or scaling in the monitor is not required.

Further features and advantages will be explained with reference to the appended drawing, showing in the sole FIGURE a non-limiting embodiment in a highly schematic block diagram of a system comprising a monitor and a computer system device according to the invention.

The FIGURE shows a monitor 1 which is coupled to a computer system device 2 via a coupling means, in this example a cable 3. The monitor 1 comprises a display device 4, such as a LCD display. The display device 4 is driven by a driving device comprising a communication device such as a LVDS receiver 5 and a timing controller 6 to drive the display device 4. The LVDS receiver 5 communicates with a LVDS transmitter 8, which is incorporated in a processing module 7 installed in the computer system device 2. The processing module 7 further comprises a scaler 9, and connection means 10 for connecting the processing module 7 to a bus structure comprised in the computer system device 2. The processing module 7 also comprises graphical processing and memory means (not shown) for generating, and storing video information and other tasks and communication means (not shown) for communication with the connection means 10. The scaler 9 comprised in the processing module 7 scales an output signal of the processing module 7 which is transmitted to the monitor 1 via the cable 3, to match the resolution of the display device 4 comprised in the monitor 1. Consequently, the video signal which is scaled by the scaler 9 and converted by the LVDS transmitter 8 into a serialised digital video signal does not need a further scaling operation in the monitor 1. Consequently, no further scaling means are required in the monitor 1, and the video signal which is led via the cable 3 to the monitor 1 and received by the LVDS receiver 5 can be applied to drive the display device 4 directly via the timing controller 6.

The monitor 1 receives electrical power from the computer system device 2 via the cable 3. According to the state of the art the computer system device 2 comprises, a power supply 11, which is powered from a mains AC voltage supply via a mains power cable 12. The power supply 11 provides at least one DC supply voltage to power a number of modules installed in the computer system device 2. The processing module 7, which is also powered by the power supply 11, forwards at least one DC supply voltage via the cable 3 to the monitor 1. In the monitor 1, the at least one DC supply voltage is fed to a power means, such as an inverter 13 which generates one or more voltages required to drive the display device 4. Furthermore, other electronics in the monitor 1, such as the LVDS receiver 5 and the timing controller 6 can of course also be powered by the DC supply voltage received via the cable 3 from the computer system device 2. As a result, the monitor 1 does not need a separate mains power supply, which further reduces dimensions and manufacturing cost of the monitor 1 and eliminates the need for a separate mains power cable for powering the monitor 1, thus reducing the number of cables required to operate the monitor 1.

The monitor 1 further comprises second peripheral communication means, in this example a USB hub 15 which is coupled via the cable 3 to first peripheral communication means on the processing module 7, in this example a connection to a USB module 14. Peripheral devices, such as a mouse 16, a keyboard 17 or any other peripheral device can be coupled in a wired or wireless form to the USB hub 15 in the monitor 1, which USB hub 15 communicates via the cable 3 with the USB module 14 in the computer system device 2. As the monitor 1 and many peripheral devices are commonly installed on a desktop or at another location which is convenient for the user, while the computer system device 2 is commonly put under a desk, in a cupboard or elsewhere, the invention allows a significant reduction of the number of cables in the computer system, as the peripheral devices which are located in the vicinity of the monitor 1 can easily and conveniently be coupled to the monitor 1. This eliminates the need for additional cabling from the peripheral devices to the computer system device 2, as the peripheral devices communicate via the USB hub 15 located in the monitor 1, via the cable 3 with the USB module 14 located in the computer system device 2. As an alternative to the USB module 14 described above, it is also possible that a USB module or USB hub or other (first) peripheral communication means is comprised in the processing module 7.

To enable the processing module 7 installed in the computer system device 2 to be applied with a variety of monitors 1 each having a display device 4 with a different resolution, the monitor 1 can transmit information about the resolution of its display device 4, or any other information, via the cable 3 to the processing module 7. Using this scaling information, the processing module 7 can adapt the resolution of the video signal to be transmitted to the monitor 1 to match the resolution of the display device 4 which is comprised in the monitor 1 connected.

Next to making use of the LVDS protocol, the processing module 7 can of course transmit the information to be visualised to the monitor 1 by making use of any other serialised protocol, such as TMDS or RSDS protocol, or any other suitable parallel or serial protocol. It is also possible to transmit the video signal from the computer system device 2 to the monitor 1 via another coupling means, for example, in a wireless way. Instead of being provided with an electrical supply via the connection means 10, the processing module and/or the monitor 1 can be provided with an electrical supply via a separate connector, such as a power connector which is commonly found in computer system devices.

Alternatively, the processing module 7 can be coupled to a display adapter according to the state of the art, incorporating graphical processing and memory means. An output of the display adapter providing, for example, a standard analog or digital video signal can be coupled to an input of the processing module 7 according to the invention. This allows the processing module 7 to be applied with an existing display adapter. If the display adapter as well as the processing module 7 are installed in a computer system device 2, the coupling can be implemented, for example, by means of a simple, short cable.

It is also possible to put the monitor 1 in a standby mode by simply switching off the supply voltage to the monitor 1, for example, with a switching means comprised in the processing module 7.

It is further possible to change a parameter of an image which is visualised by the monitor 1, such as brightness, contrast and others aspects in a user-convenient and cost-effective manner by adapting one or more parameters of the output signal of the processing module 7, and or by adapting a control signal which is transmitted from the processing module 7 to the monitor 1. The adaptation of the parameter can be performed, for example, by processing means comprised in the processing module 7. In this case, the parameter can be easily and conveniently modified in response to instructions provided by the user, for example by pressing certain keys on a keyboard 17, via a mouse 16 or other peripheral, by means of suitable software.

As a result, the invention allows implementation of a computer system having a compact, low-cost monitor 1 and a simplified cabling 3, by scaling the video signal in the computer system device 2 to the resolution required by the display device 4 comprised in the monitor 1, and by providing a DC supply voltage as well as peripheral communication means from the computer system device 2 via the cable 3 to the monitor.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. The word "comprising" does not exclude the presence of elements or steps other than those listed in a claim. The word "a" or "an" preceding an element does not exclude the presence of a plurality of such elements. The invention can be implemented by means of hardware comprising several distinct elements, and by means of a suitably programmed computer. In the device claim enumerating several means, several of these means can be embodied by one and the same item of hardware. The mere fact that certain measures are recited in mutually different dependent claims does not indicate that a combination of these measures cannot be used to advantage.

The invention claimed is:

1. A processing module for converting an input signal, which is generated in a computer system device, into a digital output signal at a video output of the computer system device, the digital output signal being adapted to be visualised by a display device, the processing module comprising:

scaling means for scaling a resolution of the output signal to match a resolution of the display device;

power supply means adapted to provide a supply voltage to a monitor accommodating the display device, the monitor being coupled to the processing module and including means for changing a value of said supply voltage to a plurality of values to drive the display device; and switching means for bringing the monitor into a standby state by reducing or removing said supply voltage.

2. The processing module as claimed in claim 1, characterized in that the processing module is integrated with a display adapter which incorporates graphical processing and memory means.

3. The processing module as claimed in claim 1, characterized by selection means for selecting a resolution for the output signal, corresponding to a resolution of the display device.

4. The processing module as claimed in claim 1, characterized in that the output signal complies with an LYDS, TMDS or RSDS protocol.

5. The processing module as claimed in claim 1, characterized in that it further comprises image adaptation means for adapting a general parameter of an image to be visualised.

6. The processing module as claimed in claim 1, characterized in that the processing module is adapted to be mounted in the computer system device.

7. The processing module as claimed in claim 6, characterized in that the processing module is adapted to be coupled to a bus structure comprised in the computer system device.

8. The processing module as claimed in claim 1 , characterized in that the processing module comprises first peripheral communication means for coupling the processing module to second peripheral communication means in the display device, wherein at least one peripheral device is coupled to the second peripheral communication means.

9. A computer system device comprising a processing module as claimed in claim 1 for transmitting information to be visualised to a monitor.

10. A method of displaying a video signal generated in a computer system device on a display device, the method comprising:

scaling, in the computer system device, a resolution of the video signal so as to match a resolution of the display device, transmitting the scaled video signal to the display device, providing a supply voltage from the computer system device to a monitor accommodating the display device, bringing the monitor into a standby state by reducing or removing said supply voltage, and changing, in the display device, value of said supply voltage to a plurality of values to drive the display device.

11. The method as claimed in claim 10, further comprising, prior to the scaling step, the step of:

inputting the resolution of the display device into the computer system device.

12. A computer system comprising:

a monitor including a inverter; and a processor unit including a power supply configured to provide a supply voltage to said monitor;

wherein said processor unit includes switching means for bringing the monitor into a standby state by reducing or removing said supply voltage, and wherein said inverter is configured to change a value of said supply voltage to a plurality of values to drive said monitor.

13. The computer system of claim 12, wherein said monitor has a monitor housing, and said processor unit has a processor housing which is separate from said monitor housing.

14. The computer system of claim 12, further comprising a cable configured to provide a connection between said monitor and said processor unit; said connection including a data line to transmit data and a power line to provide said supply voltage.

* * * * *